US009230485B2

(12) United States Patent
Byun et al.

(10) Patent No.: US 9,230,485 B2
(45) Date of Patent: Jan. 5, 2016

(54) LIQUID CRYSTAL DISPLAY AND GLOBAL DIMMING CONTROL METHOD THEREOF

(75) Inventors: Minchul Byun, Goyang-si (KR); Heumeil Baek, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 1093 days.

(21) Appl. No.: 13/291,547

(22) Filed: Nov. 8, 2011

(65) Prior Publication Data

US 2012/0120089 A1 May 17, 2012

(30) Foreign Application Priority Data

Nov. 11, 2010 (KR) ..... 10-2010-0112054

(51) Int. Cl.
*G09G 3/36* (2006.01)
*G09G 3/34* (2006.01)

(52) U.S. Cl.
CPC ..... *G09G 3/3406* (2013.01); *G09G 2320/0242* (2013.01); *G09G 2320/064* (2013.01); *G09G 2360/16* (2013.01)

(58) Field of Classification Search
CPC ..... G09G 3/3406; G09G 2360/16; G09G 2320/0242; G09G 2320/064; G02B 26/02
USPC ..... 345/102, 690
See application file for complete search history.

(56) References Cited

U.S. PATENT DOCUMENTS

2003/0030654 A1* 2/2003 Sagano et al. ..... 345/660
2007/0216616 A1* 9/2007 Stessen et al. ..... 345/84
2008/0024673 A1* 1/2008 Cha ..... 348/678

FOREIGN PATENT DOCUMENTS

CN 1961346 A 5/2007
CN 101115167 A 1/2008
CN 101562000 A 10/2009

OTHER PUBLICATIONS

Office Action issued in corresponding Chinese Patent Application No. 201110356925.6, mailed Oct. 12, 2013, 16 pages.

* cited by examiner

*Primary Examiner* — Gustavo Polo
(74) *Attorney, Agent, or Firm* — Brinks Gilson & Lione

(57) ABSTRACT

A global dimming control method of a liquid crystal display for controlling a luminance of backlight depending on a displayed image includes calculating an average picture level (APL) of the displayed image, calculating the number of pixels of a chromatic region belonging to the displayed image when the APL is equal to or less than a previously determined first threshold value, comparing the number of pixels of the chromatic region with a previously determined second threshold value, calculating a gain value of the chromatic region when the number of pixels of the chromatic region is greater than the second threshold value, and multiplying the gain value by the APL to calculate an adjustment dimming control signal, and controlling the luminance of the backlight using a dimming value obtained based on the adjustment dimming control signal.

10 Claims, 7 Drawing Sheets

LIQUID CRYSTAL DISPLAY AND GLOBAL DIMMING CONTROL METHOD THEREOF

Pursuant to 35 U.S.C. §119(a), this application claims the benefit of earlier filing date and right of priority to Korean Application 10-2010-0112054, filed on Nov. 11, 2010, the content of which is incorporated by reference herein in its entirety.

BACKGROUND

1. Field of the Invention

Embodiments of the disclosure relate to a liquid crystal display and a global dimming control method thereof capable of controlling a luminance of backlight depending on a displayed image.

2. Discussion of the Related Art

A range of application for liquid crystal displays has gradually grown because of their excellent characteristics such as light weight, thin profile, and low power consumption. The liquid crystal displays have been used in personal computers such as notebook PCs, office automation equipments, audio/video equipments, interior/outdoor advertising display devices, and the like. The liquid crystal displays display an image using a thin film transistor (TFT) as a switching element. A backlit liquid crystal display occupying most of the liquid crystal displays controls an electric field applied to a liquid crystal layer and modulates light coming from a backlight unit, thereby displaying an image.

The image quality of the liquid crystal display depends on its contrast characteristic. There is a limit to an improvement of the contrast characteristic using only a method for controlling a data voltage applied to the liquid crystal layer to modulate a light transmittance of the liquid crystal layer. Thus, a global dimming control method for adjusting a luminance of backlight depending on an input image has been proposed, so as to improve the contrast characteristic. The global dimming control method calculates an average picture level (APL) of an input image and varies a turn-on duty ratio of a pulse width modulation (PWM) signal based on the APL, thereby adjusting the luminance of the backlight. For example, as shown in FIG. 1, the global dimming control method controls the turn-on duty ratio of the PWM signal to be about 100% based on the image having the APL of about 60%; controls the turn-on duty ratio of the PWM signal to be about 60% based on the image having the APL of about 5%; and controls the turn-on duty ratio of the PWM signal to be about 50% based on the image having the APL of about 4%. As above, the global dimming control method increases the luminance of the backlight as the APL increases, and vice versa. Hence, the global dimming control method improves dynamic contrast characteristic of the image measured between adjacent frames and at the same time reduces power consumption.

As shown in FIG. 2, the global dimming control method is generally implemented at the low APL, for example, at the APL equal to or less than about 10%. Images of the low APL (for example, equal to or less than about 10%) are generally images having characters on a black background or color images of the low APL. In this instance, if the duty ratio of the PWM signal corresponding to a dimming ratio decreases based on the low APL of the image, visibility of a chromatic region in a color image of the low APL having chromatic colors is greatly reduced as shown in FIG. 3. Hence, the image quality is degraded.

BRIEF SUMMARY

A global dimming control method of a liquid crystal display for controlling a luminance of backlight depending on a displayed image, the global dimming control method includes calculating an APL of the displayed image, calculating the number of pixels of a chromatic region belonging to the displayed image when the APL is equal to or less than a previously determined first threshold value, comparing the number of pixels of the chromatic region with a previously determined second threshold value, calculating a gain value of the chromatic region when the number of pixels of the chromatic region is greater than the second threshold value, and multiplying the gain value by the APL to calculate an adjustment dimming control signal, and controlling the luminance of the backlight using a dimming value obtained based on the adjustment dimming control signal.

In another aspect, a liquid crystal display includes a liquid crystal display panel, a backlight unit including a plurality of light sources, the backlight unit irradiating light onto a back surface of the liquid crystal display panel, and a global dimming control circuit configured to control a luminance of backlight depending on an image displayed on the liquid crystal display panel, wherein the global dimming control circuit includes an APL calculating unit configured to calculate an APL of the displayed image, a chromatic region size detecting unit configured to calculate the number of pixels of a chromatic region belonging to the displayed image when the APL is equal to or less than a previously determined first threshold value, an adjustment dimming control signal calculating unit configured to find a gain value of the chromatic region, multiply the gain value by the APL, and calculate an adjustment dimming control signal, a selection signal generating unit configured to compare the number of pixels of the chromatic region with a previously determined second threshold value and output a selection signal of a first logic level when the number of pixels of the chromatic region is greater than the second threshold value, a selecting unit configured to output the adjustment dimming control signal in response to the selection signal of the first logic level, and a dimming value generating unit configured to output a dimming value for controlling the luminance of the backlight based on the adjustment dimming control signal.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE DRAWINGS AND THE PRESENTLY PREFERRED EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

Exemplary embodiments of the invention will be described with reference to FIGS. 4 to 10.

FIGS. 4 to 7 illustrate a global dimming control method capable of increasing visibility and purity of color in a color image of a low average picture level (APL).

Figure 1:
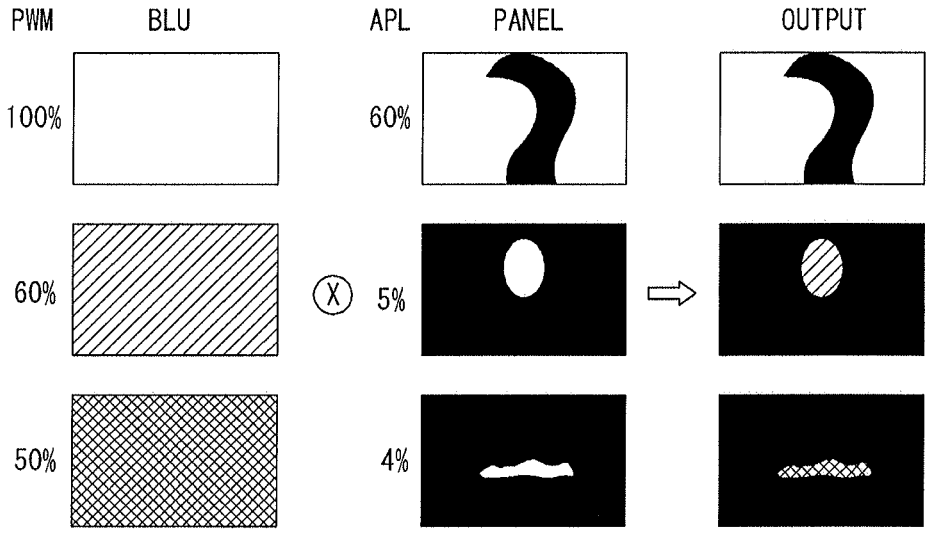
FIG. 1 (RELATED ART)
FIG. 1 illustrates a general example of a global dimming control method.
Figure 2:
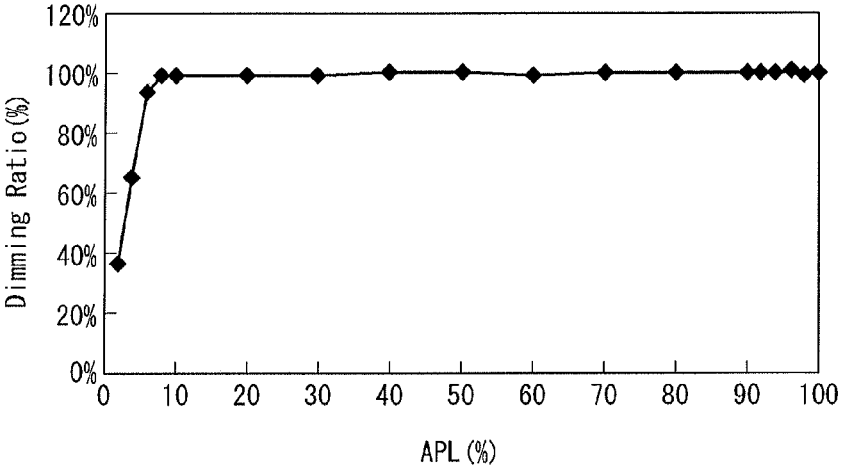
FIG. 2 (RELATED ART)
FIG. 2 illustrates a range of an average picture level (APL) range to which a global dimming control method is applied.
Figure 3:
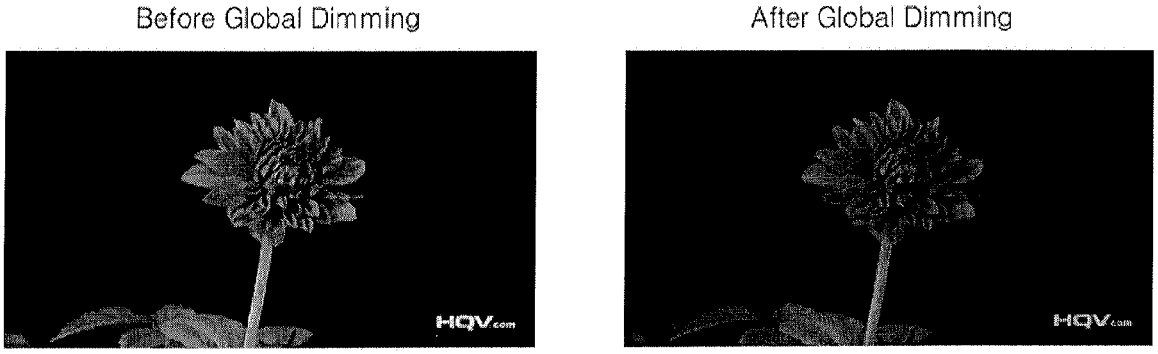
FIG. 3 (RELATED ART)
FIG. 3 illustrates an example of a degradation of the image quality of a chromatic region in a related art global dimming control method.
Figure 4:
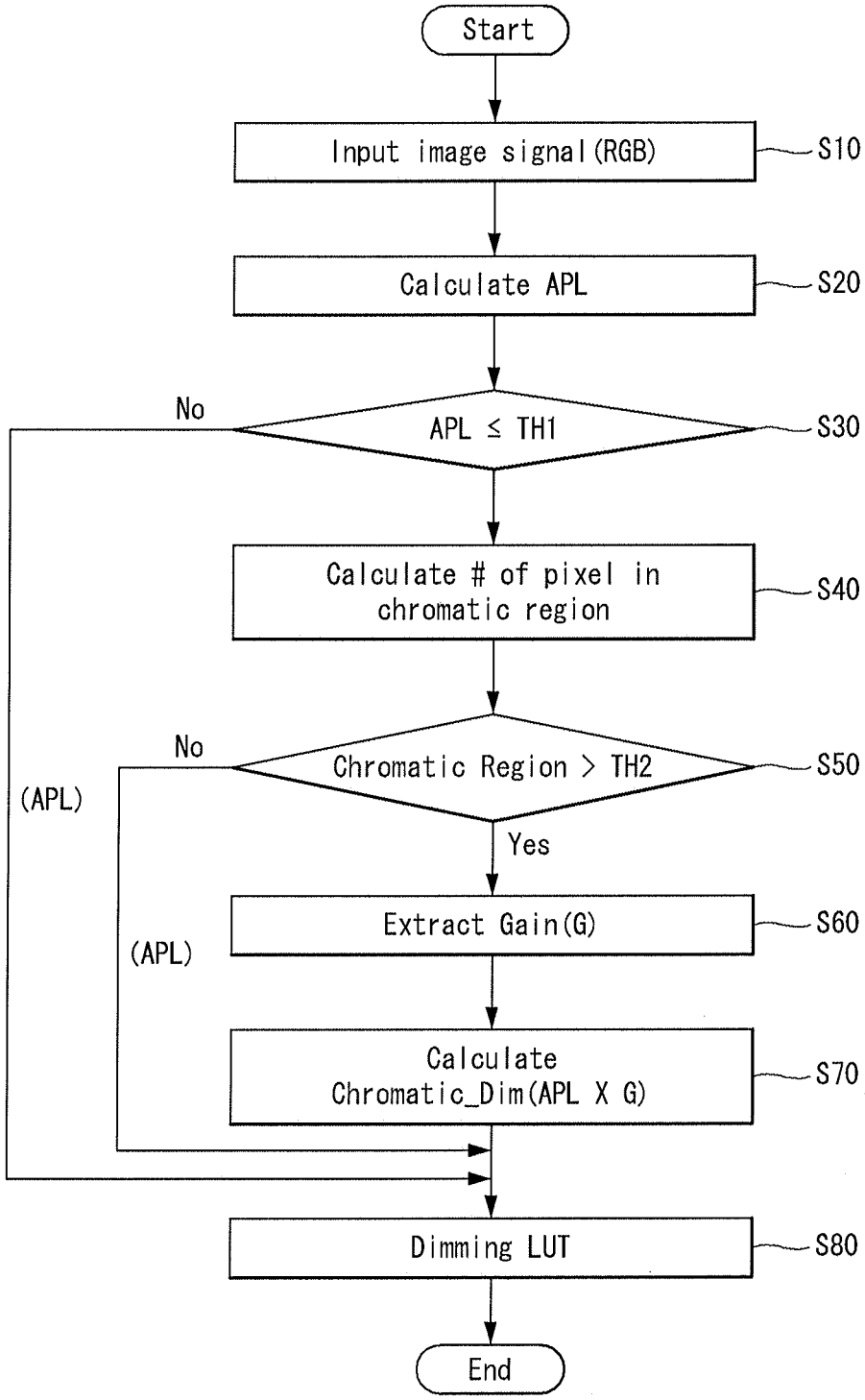
FIG. 4 illustrates a global dimming control method according to an exemplary embodiment of the invention.
Figure 5:
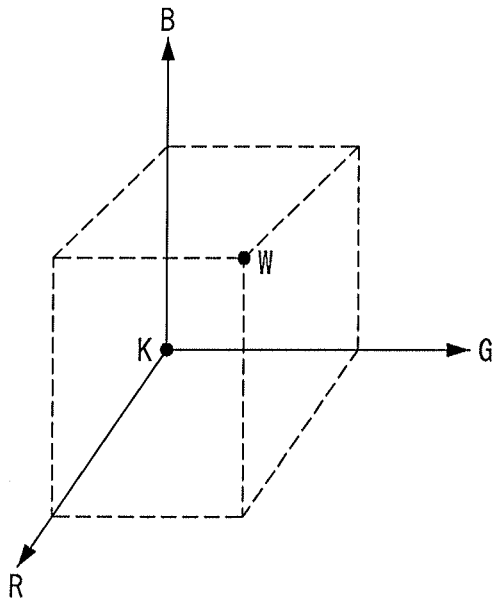
FIGS. 5 and 6 illustrate an RGB color space

As shown in FIG. 4, the global dimming control method converts input image data RGB corresponding to one frame into luminance levels using a nonlinear function such as Rec. 709 transfer function and divides a sum of the luminance levels by the total number of pixels, thereby calculating an APL of the corresponding frame in steps S10 and S20.

The global dimming control method decides whether or not the calculated APL is equal to or less than a first threshold value TH1 in step S30. In the embodiment of the invention, the first threshold value TH1 indicates a maximum value of the APL in which a dimming value can be adjusted through the global dimming control. The first threshold value TH1 may be determined to be equal to or less than about 15%. The first threshold value TH1 may vary depending on the design specifications. According to the result of decision of step S30, when the calculated APL is greater than the first threshold value TH1, steps S40 to S70 are omitted. Then, a predetermined dimming value is output through step S80. The predetermined dimming value is a value capable of dimming the backlight at a high brightness level as in the existing dimming value and may be fixed.

Figure 6:
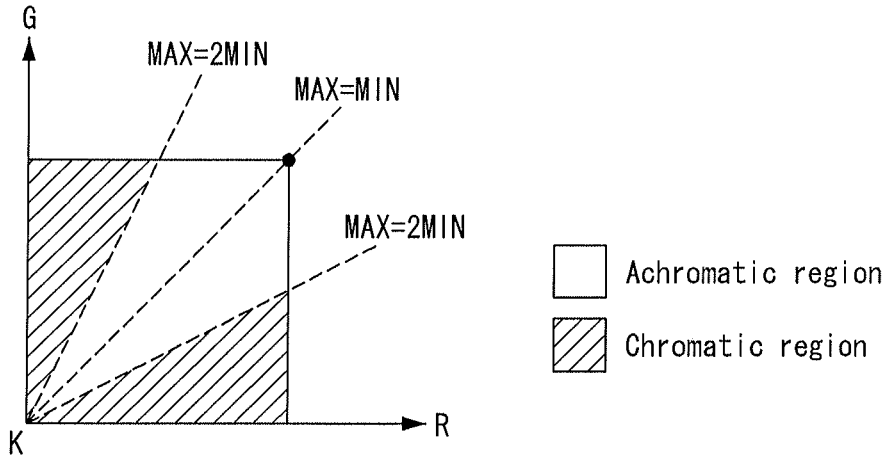
Figure 7:
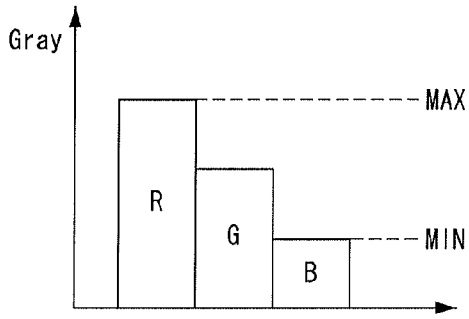
FIG. 7 illustrates an example of obtaining a maximum gray level and a minimum gray level in each pixel.

On the other hand, when the calculated APL is equal to or less than the first threshold value TH1, the global dimming control method calculates the number of pixels of a chromatic region belonging to the displayed image in step S40. For this, as shown in FIG. 7, the global dimming control method obtains a maximum gray level MAX and a minimum gray level MIM in each pixel. When the maximum gray level MAX is greater than a value obtained by multiplying the minimum gray level MIM by '$\chi$', the global dimming control method decides that the corresponding pixel appears a chromatic color in a RGB color space shown in FIGS. 5 and 6. In this instance, the global dimming control method outputs '1'. On the other hand, when the maximum gray level MAX is equal to or less than the value obtained by multiplying the minimum gray level MIM by '$\chi$', the global dimming control method decides that the corresponding pixel appears an achromatic color in the RGB color space shown in FIGS. 5 and 6. In this instance, the global dimming control method outputs '0'. In the embodiment of the invention, '$\chi$' is a setting value for deciding the chromatic region. Thus, as the setting value '$\chi$' increases, the chromatic region is decided based on a strict criterion. In FIG. 6, '$\chi$' is 2, for example. The global dimming control method performs the steps for deciding the chromatic region on all of the pixels and counts the number of '1' indicating the chromatic region during one frame. The global dimming control method calculates the number of pixels of the chromatic region through the count value.

The global dimming control method compares the number of pixels of the chromatic region with a previously determined second threshold value TH2 and decides whether or not the number of pixels of the chromatic region is greater than the second threshold value TH2 in step S50. In the embodiment of the invention, the second threshold value TH2 indicates the minimum number of pixels of the chromatic region required to increase the visibility and the purity of color in the color image of the low APL. According to the result of decision of step S50, when the number of pixels of the chromatic region is equal to or less than the second threshold value TH2, the global dimming control method reads a dimming value from a lookup table based on the APL calculated in step S20 and outputs the dimming value.

On the other hand, when the number of pixels of the chromatic region is greater than the second threshold value TH2, the global dimming control method calculates a gain value G through the following Equation 1 in step S60.

$$\text{Gain} = \left(\alpha + \frac{\#\text{ of pixel in chromatic region}}{\#\text{ of total pixel}}\right) \quad \text{[Equation 1]}$$

As indicated by the above Equation 1, the gain value G is obtained by dividing the number of pixels in the chromatic region by the total number of pixels and adding a quotient of the division to a weight value $\alpha$. In the embodiment of the invention, the weight value $\alpha$ is selected among values equal to or greater than 1, so as to increase the visibility and the purity of color in the color image of the low APL.

Subsequently, as indicated by the following Equation 2, the global dimming control method multiplies the APL obtained in step S20 by the gain value G obtained in step S60 and calculates an adjustment dimming control signal Chromatic_Dim in step S70. The adjustment dimming control signal Chromatic_Dim is obtained by multiplying the gain value G equal to or greater than 1 by the APL, and thus is equal to greater than the APL.

$$\text{Chromatic_Dim} = \text{APL} \times \text{Gain} \quad \text{[Equation 2]}$$

The global dimming control method reads a dimming value from the lookup table based on the adjustment dimming control signal Chromatic_Dim obtained in step S70 and outputs the dimming value in step S80.

Figure 8:
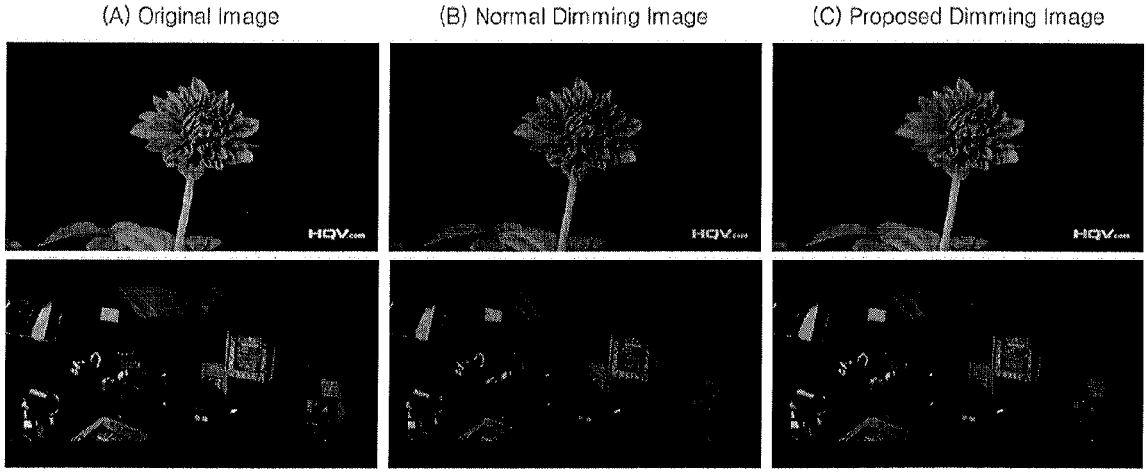
FIG. 8 illustrates an estimation result of image quality between an image displayed according to an exemplary embodiment of the invention and an image, to which only an APL is applied as in the related art.

FIG. 8 illustrates an estimation result of image quality between an image displayed according to the embodiment of the invention and an image, to which only the APL is applied as in the related art. In an estimation experiment of image quality shown in FIG. 8, the second threshold value TH2 was set to 5%, '$\chi$' was set to 2, and the weight value a was set to 1.5. In FIG. 8, (A) is an original image when a dimming ratio is 100%.

As shown in FIG. 8, the visibility and the purity of color in an image (C) displayed according to the embodiment of the invention was greatly improved using the adjustment dimming control signal Chromatic_Dim, as compared the image, to which only the APL is applied as in related art.

Figure 9:
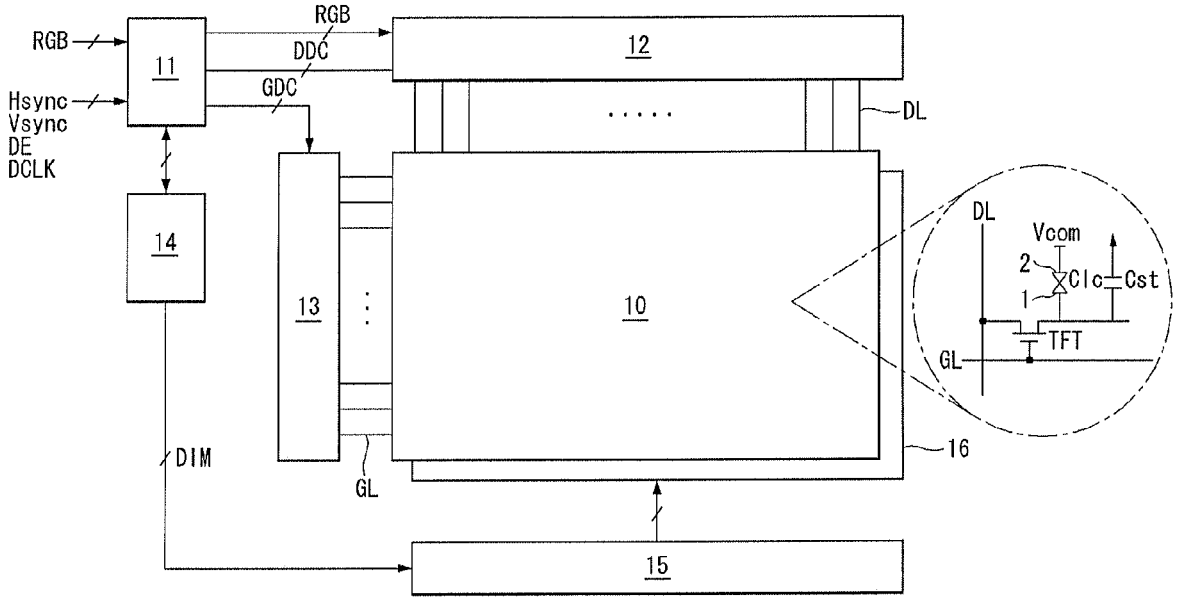
FIG. 9 illustrates a liquid crystal display according to an exemplary embodiment of the invention.

FIG. 9 illustrates a liquid crystal display according to the embodiment of the invention.

As shown in FIG. 9, the liquid crystal display according to the embodiment of the invention includes a liquid crystal display panel 10, a timing controller 11, a data driving circuit 12, a gate driving circuit 13, a global dimming control circuit 14, a backlight driving circuit 15, and a backlight unit 16.

The liquid crystal display panel 10 includes an upper glass substrate, a lower glass substrate, and a liquid crystal layer between the upper and lower glass substrates. A plurality of data lines DL and a plurality of gate lines GL cross one another on the lower glass substrate of the liquid crystal display panel 10. A plurality of liquid crystal cells Clc are arranged on the liquid crystal display panel 10 in a matrix form in accordance with a crossing structure of the data lines DL and the gate lines GL. Each of the plurality of liquid crystal cells Clc includes a thin film transistor (TFT), a pixel electrode 1 connected to the TFT, a storage capacitor Cst, and the like. Black matrixes, color filters, and common electrodes 2 are formed on the upper glass substrate of the liquid crystal display panel 10. In a vertical electric field driving manner such as a twisted nematic (TN) mode and a vertical alignment (VA) mode, the common electrode 2 is formed on the upper glass substrate. In a horizontal electric field driving manner such as an in-plane switching (IPS) mode and a fringe field switching (FFS) mode, the common electrode 2 is formed on the lower glass substrate along with the pixel electrode 1. The liquid crystal cells Clc include red (R) liquid crystal cells for displaying a red image, green (G) liquid crystal cells for displaying a green image, and blue (B) liquid crystal cells for displaying a blue image. The R, G, and B liquid crystal cells constitute a unit pixel. Polarizing plates are respectively attached to the upper and lower glass substrates of the liquid crystal display panel 10. Alignment layers for setting a pre-tilt angle of liquid crystals on the inner surfaces contacting the liquid crystals are respectively formed on the upper and lower glass substrates of the liquid crystal display panel 10.

The timing controller 11 aligns digital video data RGB received from a system board, on which an external video source is mounted, and supplies the aligned digital video data RGB to the data driving circuit 12 and the global dimming control circuit 14. The timing controller 11 receives timing signals Vsync, Hsync, DE, and DCLK from the system board. The timing controller 11 generates a data timing control signal DDC and a gate timing control signal GDC for respectively controlling operation timings of the data driving circuit 12 and the gate driving circuit 13 based on the timing signals Vsync, Hsync, DE, and DCLK. The timing controller 11 inserts an interpolation frame between frames of a signal of an input image input at a frame frequency of 60 Hz and multiplies the frequency of the data timing control signal DDC by the frequency of the gate timing control signal GDC. Hence, the timing controller 11 can control operations of the data driving unit 12 and the gate driving unit 13 at a frame frequency of (60×N) Hz, where N is a positive integer equal to or greater than 2.

The data driving circuit 12 includes a plurality of data driver integrated circuits (ICs). Each of the data driver ICs includes a shift register for sampling a clock, a register for temporarily storing the digital video data RGB, a latch that stores data corresponding to one line in response to the clock received from the shift register and simultaneously outputs the data each corresponding to one line, a digital-to-analog converter (DAC) for selecting positive and negative gamma voltages based on a gamma reference voltage corresponding to the digital data received from the latch, a multiplexer for selecting the data line DL receiving analog data converted from the positive and negative gamma voltages, an output buffer connected between the multiplexer and the data lines DL, and the like. The data driving circuit 12 latches the digital video data RGB under the control of the timing controller 11 and converts the latched digital video data RGB into positive and negative analog data voltages using positive and negative gamma compensation voltages. The data driving circuit 12 then supplies the positive and negative analog data voltages to the data lines DL.

The gate driving circuit 13 includes a plurality of gate driver ICs. Each of the gate driver ICs includes a shift register, a level shifter for converting an output signal of the shift register into a signal having a swing width suitable for a TFT drive of the liquid crystal cells, an output buffer, and the like. The gate driving circuit 13 sequentially outputs a gate pulse (or a scan pulse) under the control of the timing controller 11 and supplies the gate pulse to the gate lines GL. Hence, a horizontal line to receive the data voltage is selected.

The global dimming control circuit 14 calculates a gain value when an area the chromatic region occupies in a displayed image is greater than a predetermined value, and multiplies an APL of the displayed image by the gain value, thereby calculating an adjustment dimming control signal. The global dimming control circuit 14 then outputs a dimming value read based on the adjustment dimming control signal as a dimming value DIM for the global dimming control. Hence, the global dimming control circuit 14 uses the dimming value DIM for the global dimming control to increase the visibility and the purity of color in the color image of the low APL to which the global dimming control is applied. The global dimming control circuit 14 is described in detail with reference to FIG. 10.

The backlight driving circuit 15 drives light sources of the backlight unit 16 in response to a PWM signal, of which a duty ratio varies depending on the dimming value DIM received from the global dimming control circuit 14. As a turn-on duty ratio of the PWM signal increases, a turn-on time of the light sources increases, and vice versa. Hence, the global dimming is achieved.

The backlight unit 16 includes the plurality of light sources and irradiates light onto the liquid crystal display panel 10. The backlight unit 16 may be one of an edge type backlight unit and a direct type backlight unit. In the direct type backlight unit 16, a plurality of optical sheets and a diffusion plate are stacked under the liquid crystal display panel 10, and the plurality of light sources are disposed under the diffusion plate. In the edge type backlight unit 16, a plurality of optical sheets and a light guide plate are stacked under the liquid crystal display panel 10, and the plurality of light sources are positioned on the sides of the light guide plate. The plurality of light sources of the backlight unit 16 may be line light sources such as a cold cathode fluorescent lamp (CCFL) and an external electrode fluorescent lamp (EEFL) or point light sources such as a light emitting diode (LED).

Figure 10:
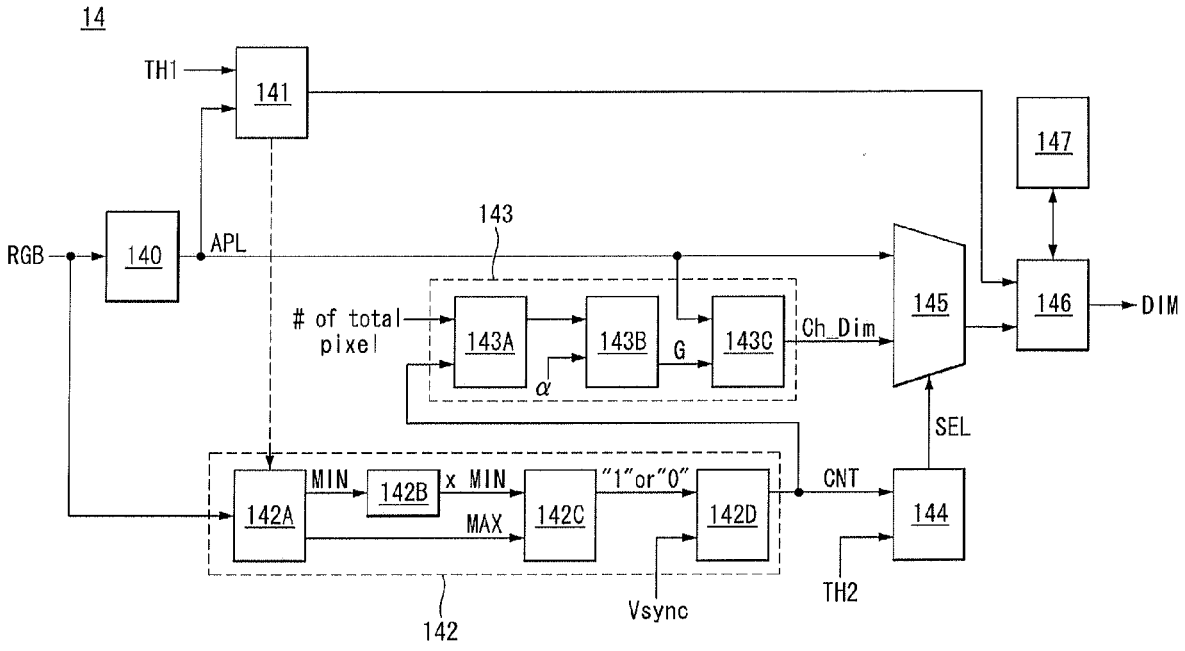
FIG. 10 illustrates a global dimming control circuit.

FIG. 10 illustrates the global dimming control circuit 14.

As shown in FIG. 10, the global dimming control circuit 14 includes an APL calculating unit 140, an APL deciding unit 141, a chromatic region size detecting unit 142, an adjustment dimming control signal calculating unit 143, a selection signal generating unit 144, a selecting unit 145, a dimming value generating unit 146, and a lookup table 147.

The APL calculating unit 140 converts image data RGB corresponding to one frame into luminance levels using a nonlinear function such as Rec. 709 transfer function and divides a sum of the luminance levels by the total number of pixels, thereby calculating an APL of the corresponding frame. The APL calculating unit 140 then outputs the APL of the corresponding frame.

The APL deciding unit 141 decides whether or not the APL received from the APL calculating unit 140 is equal to or less than a first threshold value TH1. In the embodiment of the invention, the first threshold value TH1 indicates a maximum value of the APL in which a dimming value can be adjusted through the global dimming control. The first threshold value TH1 may be determined to be equal to or less than about 15%. The first threshold value TH1 may vary depending on the design specifications. When the APL is greater than the first threshold value TH1, the APL deciding unit 141 inactivates operations of the components 142 to 145 and supplies the APL to the dimming value generating unit 146. The dimming value generating unit 146 outputs a predetermined dimming value corresponding to the APL exceeding the first threshold value TH1. The predetermined dimming value is a value capable of dimming the backlight at a high brightness level as in the existing dimming value and may be fixed. On the other hand, when the APL is equal to or less than the first threshold value TH1, the APL deciding unit 141 activates operations of the components 142 to 145 for the global dimming control.

The chromatic region size detecting unit 142 detects an area the chromatic region occupies in the displayed image. The chromatic region size detecting unit 142 includes a MIN/MAX obtaining unit 142A, a multiplication unit 142B, a comparator 142C, and a counter 142D. The MIN/MAX obtaining unit 142A obtains a maximum gray level MAX and a minimum gray level MIM in each pixel. The multiplication unit 142B multiplies the minimum gray level MIM received from the MIN/MAX obtaining unit 142A by a setting value '$\chi$' previously determined to decide the chromatic region. The comparator 142C compares the maximum gray level MAX received from the MIN/MAX obtaining unit 142A with a multiplication value $\chi$MIM received from the multiplication unit 142B in each pixel. When the maximum gray level MAX is greater than the multiplication value $\chi$MIM, the comparator 142C outputs '1'. On the other hand, when the maximum gray level MAX is equal to or less than the multiplication value $\chi$MIM, the comparator 142C outputs '0'. In the embodiment of the invention, '1' indicates that the corresponding pixel appears a chromatic color in the RGB color space, and '0' indicates that the corresponding pixel appears an achromatic color in the RGB color space. The counter 142D counts the pixels having the value of '1' during one frame based on the vertical sync signal Vsync and outputs a count value CNT as the number of pixels of the chromatic region.

The adjustment dimming control signal calculating unit 143 calculates an adjustment dimming control signal Ch_Dim based on the count value CNT (corresponding to the number of pixels of the chromatic region) received from the chromatic region size detecting unit 142. The adjustment dimming control signal calculating unit 143 includes a dividing unit 143A, an adding unit 143B, and an adjustment dimming control signal generating unit 143C. The dividing unit 143A divides the count value CNT by the total number of pixels. The adding unit 143B adds a quotient of the division received from the dividing unit 143A to a weight value $\alpha$, thereby outputting a gain value G. In the embodiment of the invention, the weight value $\alpha$ is selected among values equal to or greater than 1, so as to increase the visibility and the purity of color in the color image of the low APL. The adjustment dimming control signal generating unit 143C multiplies the gain value G received from the adding unit 143B by the APL received from the APL calculating unit 140, thereby generating the adjustment dimming control signal Ch_Dim. The adjustment dimming control signal Ch_Dim is obtained by multiplying the gain value G equal to or greater than 1 by the APL, and thus is equal to or greater than the APL.

The selection signal generating unit 144 compares the count value CNT corresponding to the number of pixels of the chromatic region with a previously determined second threshold value TH2 and decides whether or not the count value CNT is greater than the second threshold value TH2. In the embodiment of the invention, the second threshold value TH2 indicates the minimum number of pixels of the chromatic region required to increase the visibility and the purity of color in the color image of the low APL. When the count value CNT is greater than the second threshold value TH2, the selection signal generating unit 144 outputs a selection signal SEL of a first logic level. On the other hand, when the count value CNT is equal to or less than the second threshold value TH2, the selection signal generating unit 144 outputs the selection signal SEL of a second logic level.

The selecting unit 145 selectively outputs the adjustment dimming control signal Ch_Dim received from the adjustment dimming control signal calculating unit 143 and the APL received from the APL calculating unit 140 in response to the selection signal SEL received from the selection signal generating unit 144. The selecting unit 145 outputs the adjustment dimming control signal Ch_Dim in response to the selection signal SEL of the first logic level and outputs the APL in response to the selection signal SEL of the second logic level.

The dimming value generating unit 146 receives the adjustment dimming control signal Ch_Dim or the APL from the selecting unit 145. The dimming value generating unit 146 reads a dimming value from the lookup table 147 using the adjustment dimming control signal Ch_Dim or the APL as a read address and outputs the dimming value. The lookup table 147 previously stores dimming values mapped to the read address. As the read address increases, the dimming values mapped to the read address increase.

As described above, the liquid crystal display and the global dimming control method thereof according to the embodiment of the invention control the luminance of the backlight using a dimming value greater than a dimming value corresponding to an APL of the displayed image when an area the chromatic region occupies in the displayed image, to which the global dimming control is applied, is greater than a predetermined value, thereby increasing the visibility and the purity of color in the color image of the low APL.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A global dimming control method of a liquid crystal display for controlling a luminance of backlight depending on a displayed image, the global dimming control method comprising:

calculating an average picture level (APL) of the displayed image;

calculating the number of pixels of a chromatic region belonging to the displayed image when the APL is equal to or less than a previously determined first threshold value;

comparing the number of pixels of the chromatic region with a previously determined second threshold value, calculating a gain value of the chromatic region when the number of pixels of the chromatic region is greater than the second threshold value, and multiplying the gain value by the APL to calculate an adjustment dimming control signal; and controlling the luminance of the backlight using a dimming value obtained based on the adjustment dimming control signal wherein the first threshold value indicates a maximum value of the APL in which a dimming value can be adjusted through global dimming control, and the second threshold value indicates the minimum number of pixels of the chromatic region.

2. The global dimming control method of the liquid crystal display of claim 1, wherein the calculating of the number of pixels of the chromatic region includes:

obtaining a maximum gray level and a minimum gray level in each pixel;

multiplying the minimum gray level by a previously determined value for deciding the chromatic region to generate a multiplication value; and comparing the maximum gray level with the multiplication value in each pixel, counting the pixels, in which the maximum gray level is greater than the multiplication value, and outputting a count value as the number of pixels of the chromatic region.

3. The global dimming control method of the liquid crystal display of claim 1, wherein the gain value is obtained by dividing the number of pixels of the chromatic region by the total number of pixels and adding a quotient of the division to a previously determined weight value.

4. The global dimming control method of the liquid crystal display of claim 3, wherein the weight value is equal to or greater than 1, and the adjustment dimming control signal is equal to or greater than the APL.

5. The global dimming control method of the liquid crystal display of claim 1, further comprising, when the number of pixels of the chromatic region is equal to or less than the second threshold value, controlling the luminance of the backlight using a dimming value obtained based on the APL.

6. A liquid crystal display comprising:

a liquid crystal display panel;

a backlight unit including a plurality of light sources, the backlight unit irradiating light onto a back surface of the liquid crystal display panel; and a global dimming control circuit configured to control a luminance of backlight depending on an image displayed on the liquid crystal display panel, the global dimming control circuit including:

an average picture level (APL) calculating unit configured to calculate an APL of the displayed image;

a chromatic region size detecting unit configured to calculate the number of pixels of a chromatic region belonging to the displayed image when the APL is equal to or less than a previously determined first threshold value;

an adjustment dimming control signal calculating unit configured to find a gain value of the chromatic region, multiply the gain value by the APL, and calculate an adjustment dimming control signal;

a selection signal generating unit configured to compare the number of pixels of the chromatic region with a previously determined second threshold value and output a selection signal of a first logic level when the number of pixels of the chromatic region is greater than the second threshold value;

a selecting unit configured to output the adjustment dimming control signal in response to the selection signal of the first logic level; and a dimming value generating unit configured to output a dimming value for controlling the luminance of the backlight based on the adjustment dimming control signal;

wherein the first threshold value indicates a maximum value of the APL in which a dimming value can be adjusted through global dimming control, and the second threshold value indicates the minimum number of pixels of the chromatic region.

7. The liquid crystal display of claim 6, wherein the chromatic region size detecting unit includes:

a MIN/MAX obtaining unit configured to obtain a maximum gray level and a minimum gray level in each pixel;

a multiplication unit configured to multiply the minimum gray level by a previously determined value for deciding the chromatic region and generate a multiplication value;

a comparator configured to compare the maximum gray level with the multiplication value in each pixel; and a counter configured to count the pixels, in which the maximum gray level is greater than the multiplication value, and output a count value as the number of pixels of the chromatic region.

8. The liquid crystal display of claim 6, wherein the gain value is obtained by dividing the number of pixels of the chromatic region by the total number of pixels and adding a quotient of the division to a previously determined weight value.

9. The liquid crystal display of claim 8, wherein the weight value is equal to or greater than 1, and the adjustment dimming control signal is equal to or greater than the APL.

10. The liquid crystal display of claim 6, wherein the selection signal generating unit outputs the selection signal of a second logic level when the number of pixels of the chromatic region is equal to or less than the second threshold value, wherein the selecting unit outputs the APL in response to the selection signal of the second logic level, wherein the dimming value generating unit outputs a dimming value for controlling the luminance of the backlight based on the APL.

* * * * *